United States Patent [19]

Gibb

[11] Patent Number: 4,499,369

[45] Date of Patent: Feb. 12, 1985

[54] HEATING ELEMENT ARRANGEMENT FOR A VACUUM FURNACE

[75] Inventor: Thomson B. Gibb, Southampton, Pa.

[73] Assignee: Vacuum Furnace System Corporation, Souderton, Pa.

[21] Appl. No.: 496,635

[22] Filed: May 20, 1983

[51] Int. Cl.[3] ..... H05B 3/10

[52] U.S. Cl. ..... 219/552; 219/270; 219/535

[58] Field of Search ..... 219/270, 408, 244, 422, 219/426, 523, 456, 534, 535, 537, 538, 539, 552, 553; 361/266

[56] References Cited

U.S. PATENT DOCUMENTS

| | | | |
|---|---|---|---|
| 1,517,271 | 12/1924 | Woodson | 219/539 X |
| 1,933,851 | 11/1933 | Gränzer | 219/422 |
| 1,961,136 | 6/1934 | Cretors | 219/426 |
| 2,272,658 | 2/1942 | Challet | 219/456 X |
| 2,809,223 | 10/1957 | Stevenson | 219/553 X |
| 2,938,988 | 5/1960 | McCutcheon et al. | 219/270 |
| 3,056,712 | 10/1962 | Imhof | 219/539 X |
| 3,434,012 | 3/1969 | Radamacher | 361/266 X |
| 3,812,323 | 5/1974 | Pink | 219/535 |

*Primary Examiner*—Volodymyr Y. Mayewsky

*Attorney, Agent, or Firm*—William E. Cleaver

[57] ABSTRACT

The present invention employs a heating element means which is formed into an endless configuration, i.e., a closed plane, circular configuration, loop, etc. In a preferred embodiment the heating element means comprises a molybdenum strip although a plurality of molybdenum sections, which are secured to one another to make up a continuous sectionalized strip could be used. When such a strip conducts electrical current there is heat generated ($I^2R$) and such heated strips are the source of heat for the hot zone chamber of a vacuum furnace. There are a number of such continuous strips which make up the overall heating element means for a hot zone chamber. The continuous strips, or heating elements, each has first and second terminal means secured thereto at respectively first and second different locations, so that between said first and second terminals there exist two separated electrical current paths, or a bifurcated path. The first and second terminals are adapted to be connected to an electrical current power source or in series, whereby when electrical current is provided by an electrical current supply source, the current divides as it passes through the bifurcated path (and heat is generated around the entire closed panel) and said current is joined at the second terminal to be returned to the electrical current supply.

2 Claims, 6 Drawing Figures

FIG. 1A
(PRIOR ART)
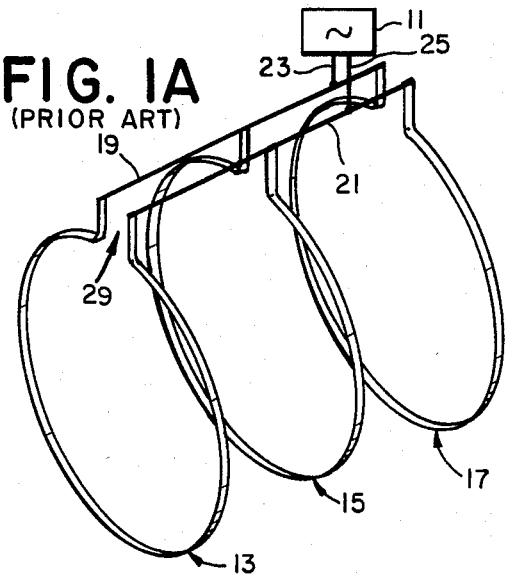
FIG. 1B
(PRIOR ART)
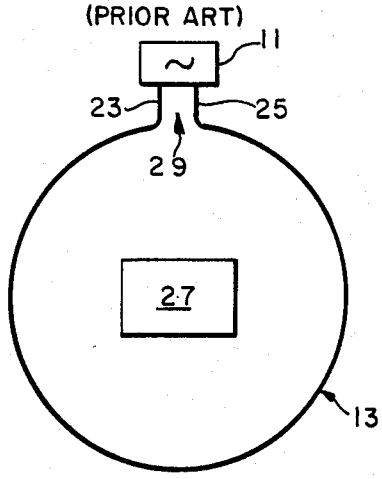
FIG. 2A
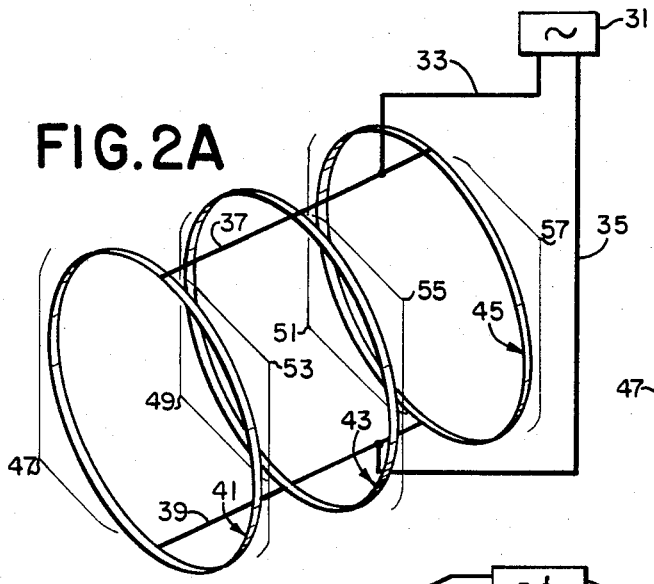
FIG. 2B
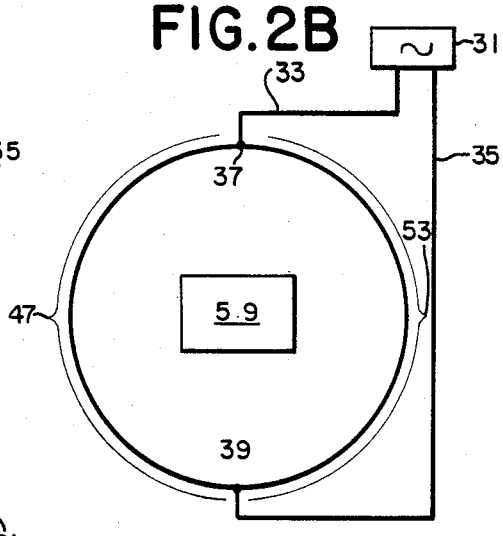
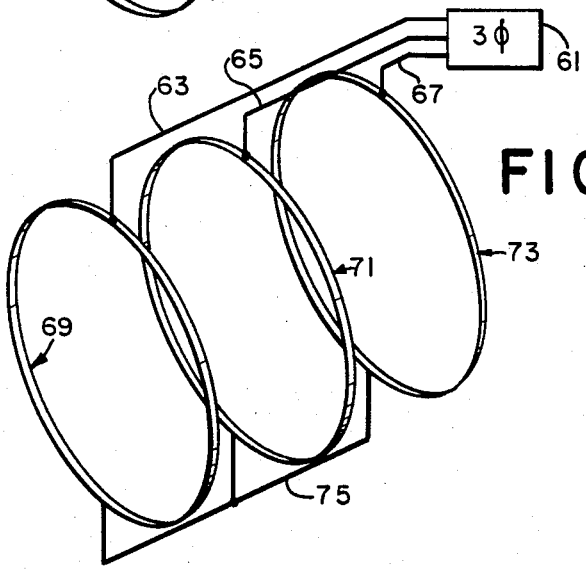
FIG. 3
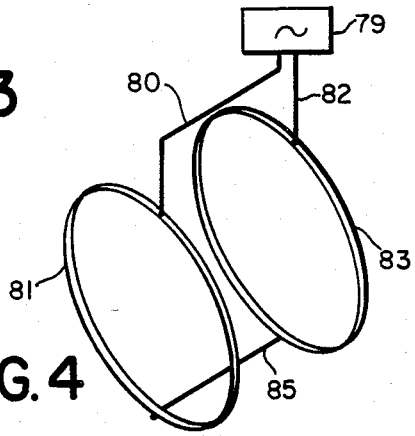
FIG. 4

HEATING ELEMENT ARRANGEMENT FOR A VACUUM FURNACE

BACKGROUND

The passing of electrical current through molybdenum strips to provide a source of heat for a vacuum furnace is well understood and commonly used. However, in the prior art, the heating element is formed into a configuration which resembles the profile of an electric light bulb, that is the strip is not closed at the bottom of its loop or bulbous section but instead has two unconnected ends which are formed into a neck like protrusion from the opening of the bulbous section. The two unconnected ends serve as terminals which are connected to an electrical current supply so that electrical current passes through one terminal, through the open loop and is returned through the other terminal to the electrical current supply source. Such a configuration gives rise to a "cold spot" in the area where the two unconnected ends join the open loop because the loop per se is not radiating heat toward the load at the cold spot area while the workpiece is radiating heat toward the cold spot area. To say it another way, the open section of the loop acts as a heat sink. The workpiece and the heating element both reflect and radiate heat toward the open section of the heating element, i.e. between the unconnected ends because there is a temperature differential between the hot zone encompassed by the open loop portion of the heating element and the open section of the heating element. The "cold spot" causes nonuniform heating of the workpiece and this can be undesirable for at least two reasons. First the loss of heat which should be acting on a portion of the workpiece causes it to be improperly "heat treated." For instance if there were a tray of pieces to be sintered as the workpiece, there would result a number of pieces that were not properly sintered. In the prior art such an infirmity is dealt with by increasing the heat beyond the point necessary to accomplish the heat treating process and such a procedure is critical because increased heat often damages the workpiece. The present invention provides a heating element which eliminates the "cold spot" and the problems arising therewith.

SUMMARY

The present invention deals with the elimination of the "cold spot" that is present in prior art heating elements which are used in a hot zone chamber in a vacuum furnace. The present invention employs a continuous heating element. In a preferred embodiment the heating element is fabricated from a strip of molybdenum although a plurality of molybdenum segments which are connected together end to end to form a closed plane, i.e., a circular configuration, a rectangle or the like could be used. In a preferred embodiment, on the closed plane heating element there are fashioned two terminals to which electrical power cables are fastened. In another embodiment, the terminals are on adjacent elements and the elements are connected in series. The terminals are disposed, or lie, on substantially opposite sides of the circular configuration thus creating a bifurcated path between the two terminals. Hence when electrical current is transmitted to one terminal, the electrical current divides with part going down a path (i.e., a first section of the heating element) from one terminal to the other and the remainder of the electrical current passes along a second path (i.e., a second section of the heating element) from one terminal to the other. In this way the area surrounded by the closed plane heating element is heated uniformly. There are no cold spots. In a preferred embodiment there is more than one heating element, (i.e., more than one closed plane structure) making up the overall heating device for the hot zone chamber. In one configuration the heating elements are connected in parallel, while in another configuration the heating elements are connected such that one element is in series with two of the other elements, the latter two elements being connected in parallel. The heating element in the preferred embodiment is made from molybdenum but other materials which heat up when electrical current passes therethrough could be used provided they can be heated to 3,000° F. without deterioration.

The objects and features of the present invention will be better understood in view of the following description taken in conjunction with the drawings wherein:

FIG. 1A shows a pictorial schematic of a prior art heating device composed of three heating elements;

FIG. 1B is an end view of the device shown in FIG. 1A;

FIG. 2A shows a heating device, in accordance with the present invention, made up of three heating elements connected in parallel;

FIG. 2B shows an end view of the structure of 2A;

FIG. 3 shows a three heating element heating device, in accordance with the present invention, wherein the power is three phase power; and FIG. 4 depicts two heating elements connected in series.

Consider FIGS. 1A and 1B. In FIG. 1A there is shown a source of power 11 which is connected to three heating elements 13, 15 and 17. The heating elements 13, 15 and 17, as shown in FIGS. 1A and 1B, represent the arrangement of the prior art. As can be seen in FIG. 1A, the heating elements 13, 15 and 17 are connected in parallel to two common connections 19 and 21 which are in turn connected to the two cables 23 and 25. The cables 23 and 25 are connected to the source of power 11. Hence when electrical current is passed to the heating elements 13, 15 and 17 to cause those heating elements to "heat up," the current passes along the cable 23, through the common connection 19, through each of the heating elements 13, 15 and 17, back to the common connection 21, back along the cable 25 to the source of power 11. The heating elements 13, 15 and 17 radiate heat into the space within the heating elements and this can be best seen in FIG. 1B. In FIG. 1B there is shown a workpiece 27 which is located within the heating element 13 and while the heating elements 15 and 17 are not readily shown in FIG. 1B, it should be understood that the workpiece extends into the drawing and therefore is within the space defined by the heating elements 15 and 17. The heating elements are made of material, such as molybdenum, which heats up when electrical current passes therethrough and hence the heating elements radiate heat toward the workpiece 27. When a heating element in the prior art is used, it is used or located within a heat insulated chamber. Accordingly the heat is contained within the chamber and the heat continues to "heat treat" the workpiece such as workpiece 27. However in the prior art configuration, shown by FIGS. 1A and 1B there is no heat radiated from the gap 29. In point of fact the difference in temperature between the gap 29 and the remainder of the space located within the heating elements 13, 15 and 17 is such that heat from the heating element moves toward the gap 29 and in effect the gap 29 acts as a heat sink. In addition the workpiece which gets heated up also radiates heat and that heat is radiated in great measure toward the cold spot represented by the gap 29. The effect of the cold spot 29, or the heat sink, causes a portion of the workpiece 27 to be nonuniformally heated. To say it another way the section of the workpiece lying opposite the gap 29 does not get heated to the extent that the remaining part of the workpiece gets heated. In some forms of heat treating, for instance sintering, it has been found that the workpieces are not properly sintered at the position lying opposite the cold spot. In order to overcome this problem, in the prior art, excessive heat has been generated by the heating element. While this technique may often provide sufficient heat to properly heat treat all portions of the workpiece, it is a waste of energy and secondly very often the excess of heat does damage to other sections of the workpiece. The present invention is designed to eliminate the cold spot.

Consider the FIGS. 2A and 2B. In FIGS. 2A and 2B there is shown a source of power 31. Connected to the source of power are two cables 33 and 35. The cables 33 and 35 are connected to two common connections or common terminals 37 and 39. Connected to the two common terminals 37 and 39 are three heating elements 41, 43 and 45. It should be noted that the common connections 37 and 39 are connected on opposite sides of the heating elements 41, 43 and 45 so that between the common connections 37 and 39 there is a bifurcated path or three bifurcated paths if the elements are thought of as individual paths. In the prior art the leads 23 and 24 were located in close proximity at the place that they were taken out of the vacuum furnace, while in accordance with the present invention the leads are located at remote places where they are taken out of the vacuum furnace. In accordance with the arrangement shown in FIGS. 2A and 2B, when the heating elements are to be "heated up" electrical current is passed along the line 33, along the common terminal 37, and part of that current passes to the left along the sections 47, 49 and 51 to the common terminal 39 and therealong through the cable 35 back to the power source 31. The other portion of the electrical current passes through the other sections 53, 55 and 57 of the bifurcated path to the common terminal 39 and therefrom along the cable 35 to the source of power 31. Hence the current divides as it leaves the common terminal 37 and passes through the bifurcated path and joins, or is accumulated, at the common terminal 39 to be returned along the cable 35. In a preferred embodiment the ohmic value of the two sections of the bifurcated path are substantially equal.

The relationship of the workpiece 59 to the heating element 41 and hence to the heating elements 43 and 45 can be gleaned from an examination of FIG. 2B. In FIG. 2B the workpiece 59 is shown in the space defined by the closed plane of the heating element 41. As the heating element 41 (and of course the heating elements 43 and 45) is heated by the electrical current passing therethrough as described above, that heat is radiated toward the workpiece 59 and properly heat treats that workpiece. As can be seen from the examination of FIGS. 2A and 2B there is no cold spot, i.e., no gap, in the heating element and therefore there is no heat sink effect with respect to the heat generated by the heating element. To say it another way, the heat that is generated by the heating element is transmitted to the workpiece 59 to properly heat treat the workpiece. Accordingly there is no wasted energy as there is in the prior art hot zone arrangement and there is no necessity to overheat with the risk of damage in order to compensate for the heat loss to the cold spot as is true in the prior art.

In FIG. 3 there is shown an arrangement of the heating elements when the system is used with a three phase power supply. In FIG. 3 there is shown a three phase source of power 61. The three phase source of power 61 is connected through the cables 63, 65 and 67 to the closed plane heating elements 69, 71 and 73. The heating elements 69, 71 and 73 are common connected by the common connection 75 as shown in FIG. 3. Accordingly, when the three phase power is transmitting current into the system and line 63 is at the high potential value, current will flow through the line 63 through bifurcated path set up by the heating element 69 to the common connection 75 and therefrom through the parallel paths of the heating elements 71 and 73 back to the lines 65 and 67 to the three phase power source 61. As the power source shifts its voltage 120°, the line 65 will become the high voltage line providing current on the line 65, through the bifurcated path 71 to the common connection 75, and thereafter through the parallel paths represented by the heating element 69 and 73 along the lines 63 and 67 to the three phase power source 61. It should be recognized that when the current is passing through the parallel paths such as heating elements 69 and 73 that the current is passing through both halves of each heating element and therefore at all times all three heating elements are radiating heat (from bifurcated paths) to the workpiece that is held in the center of the space defined by those heating elements. It can readily be seen that in the configuration of the heating elements in FIG. 3 there is no gap, hence there is no cold spot and the workpiece is fully heat treated without the infirmities that arise in connection with the prior art.

In FIG. 4 another embodiment is shown. In the arrangement of FIG. 4, there is a power source 79 connected to two heating elements, 81 and 83. It should be noted that the heating elements 81 and 83 are common connected by the strap 85. Electrical current passes from the power source 79, along the wire 80, through the bifurcated path of the heating element 81, along the strap 85, through the bifurcated path 83, to the return line 82. In this arrangement there is no "cold spot." Additional heating elements can be added by series connecting adjacent heating elements as they are added to the stack.

It has been found that by employing the complete heating element arrangement as shown in FIGS. 2A, 2B, 3 and FIG. 4 that the workpiece is better "heat treated" than has been true in the prior art. It has been further found that the workpiece can be much larger because there is no need to compensate for nonuniformity as there is in the prior art. In addition the heating element can be made larger, so as to substantially fill the hot zone chamber spaces. It has further been found that the only problem involved (with respect to the structure of FIGS. 2A, 2B and 3) is in arranging for the power cable to go out on opposite sides of the vacuum furnace and this is easily accomplished. Hence the inventive arrangement of heating elements shown in FIGS. 2A, 2B, 3 and FIG. 4 is a decided improvement over the prior art arrangement of heating elements as shown in FIGS. 1A and 1B.

I claim:

1. A heating means for use in a hot zone chamber of a vacuum furnace comprising in combination: at least first and second heating elements formed of material that generates heat in response to electrical current passing therethrough and formed in a closed plane so that when said elements are generating heat there are no cold spots; at least first and second terminal means respectively secured to said first and second heating elements; electrical current path means connecting said first and second heating elements at respective locations thereof which respectively lie substantially opposite said first and second terminals so that there is a serial ohmic connection between said first and second terminals, which serial ohmic connection is bifurcated through said first and second heating elements; and electrical current supply means to supply electrical current to said first and second terminals so that electrical current, because of said series connection, passes through said first terminal, becomes divided as it passes through the bifurcated path defined by said first heating element to said electrical current path means, passes through said electrical current path means to be divided along the bifurcated path defined by said second heating element to said second terminal to be returned to said electrical current supply means, whereby said first and second heating elements present a high impedance and become heated completely without leaving a cold spot.

2. A heating means for use in a hot zone chamber of a vacuum furnace comprising in combination: first, second and third heating elements, each formed of material that generates heat in response to electrical current passing therethrough and each formed in a closed plane so that when said elements are generating heat there are no cold spots; first, second and third terminal means respectively secured to said first, second and third heating elements; electrical current path means connecting said first, second and third heating elements at respective locations thereof which respectively lie substantially opposite said first, second and third terminals so that, (1) there is a first serial ohmic connection between said first and second terminals, which first serial ohmic connection is bifurcated through said first and second heating elements, (2) there is a second serial ohmic connection, between said first and third terminals, which second serial ohmic connection is bifurcated through said first and third heating elements, (3) there is a third serial ohmic connection between said second and third terminals which third serial ohmic connection is bifurcated through said second and third heating elements; and three phase electrical current supply means to supply three phase electrical current to said first, second and third terminals so that electrical current, in a three phase pattern and in series connection, passes through each of said terminals to each of the other terminals, whereby said first, second and third heating elements present a high impedance and each becomes heated completely without leaving a cold spot.

* * * * *